US009458638B2

(12) United States Patent
Parkes et al.

(10) Patent No.: US 9,458,638 B2
(45) Date of Patent: Oct. 4, 2016

(54) LEAVE-IN-PLACE CONCRETE FORMWORK COMBINING PLATE DOWELS, DIVIDER PLATES, AND/OR FINISHING, ARMORING AND/OR SEALING MOLDING

(71) Applicant: Illinois Tool Works Inc., Glenview, IL (US)

(72) Inventors: Nigel K Parkes, Atlanta, GA (US); Russell Boxall, Charlotte, NC (US)

(73) Assignee: Illinois Tool Works Inc., Glenview, IL (US)

( * ) Notice: Subject to any disclaimer, the term of this patent is extended or adjusted under 35 U.S.C. 154(b) by 10 days.

(21) Appl. No.: 14/629,274

(22) Filed: Feb. 23, 2015

(65) Prior Publication Data

US 2015/0167328 A1 Jun. 18, 2015

Related U.S. Application Data

(63) Continuation of application No. 13/943,374, filed on Jul. 16, 2013, now abandoned.

(60) Provisional application No. 61/673,061, filed on Jul. 18, 2012.

(51) Int. Cl.

| | |
|---|---|
| ***E04B 1/68*** | (2006.01) |
| ***E04D 13/15*** | (2006.01) |
| ***E04G 17/06*** | (2006.01) |
| ***E04B 1/41*** | (2006.01) |
| ***E04B 1/48*** | (2006.01) |

(Continued)

(52) U.S. Cl.

CPC ..... *E04G 17/06* (2013.01); *E01C 11/04* (2013.01); *E01C 11/14* (2013.01); *E04B 1/4114* (2013.01); *E04B 1/483* (2013.01); *E04F 15/142* (2013.01); *E04G 17/0644* (2013.01)

(58) Field of Classification Search

CPC ..... E04B 1/483; E04B 1/4114; E01C 11/04; E01C 11/14; E04F 15/142; E04G 17/06; E04G 17/0644

USPC ..... 52/393, 395, 396.02, 396.04, 396.05, 52/396.09, 512, 513, 514; 404/47, 51, 57, 404/75

See application file for complete search history.

(56) References Cited

U.S. PATENT DOCUMENTS 1,357,713 A 11/1920 Lane
6,354,760 B1 3/2002 Boxall et al.

(Continued)

FOREIGN PATENT DOCUMENTS

WO WO 2010/043003 4/2010

OTHER PUBLICATIONS

Canadian Office Action dated Oct. 28, 2014 for Canadian Application No. 2,821,494 (3 pages).

(Continued)

*Primary Examiner* — James Buckle, Jr.
(74) *Attorney, Agent, or Firm* — Neal, Gerber & Eisenberg LLP

(57) ABSTRACT

A leave-in-place forming system for concrete slabs and pavements that comprises a number of components including two or more of the following: a plate dowel for load transfer between adjacent concrete panels (joint stability), a divider plate, and an assembly or molding to finish the concrete to, that armors the joint and/or provides a water-tight seal to the joint. The joint assembly could incorporate an integral setting assembly or bracket or could be used with a re-usable setting bracket. The integral assembly or bracket is most suitable when it is desirable to place concrete to both sides of the joint assembly at the same time. The re-usable setting bracket is most suitable where concrete is placed to just one side of the assembly and it is desirable to re-use the setting assembly.

34 Claims, 2 Drawing Sheets

(51) Int. Cl.

| | |
|---|---|
| ***E01C 11/04*** | (2006.01) |
| ***E01C 11/14*** | (2006.01) |
| ***E04F 15/14*** | (2006.01) |

(56) References Cited

U.S. PATENT DOCUMENTS

| | | | |
|---|---|---|---|
| 7,481,031 | B2 | 1/2009 | Boxall et al. |
| 7,716,890 | B2 | 5/2010 | Boxall et al. |
| 8,627,627 | B2 | 1/2014 | Findlay |
| 8,672,579 | B2 | 3/2014 | Laiho et al. |
| 2008/0222984 | A1 | 9/2008 | Michiels |

OTHER PUBLICATIONS

Canadian Office Action dated Jun. 30, 2015 for Canadian Application No. 2,821,494 (3 pages).

Mexican Office Action dated Aug. 31, 2015 for Mexican Application No. MX/a/2013/008396 (4 pages).

LEAVE-IN-PLACE CONCRETE FORMWORK COMBINING PLATE DOWELS, DIVIDER PLATES, AND/OR FINISHING, ARMORING AND/OR SEALING MOLDING

PRIORITY CLAIM

This application is a continuation of, and claims priority to and the benefit of, U.S. patent application Ser. No. 13/943,374, filed on Jul. 16, 2013, which claims priority to and the benefit of U.S. Provisional Patent Application Ser. No. 61/673,061, filed on Jul. 18, 2012, the entire contents of each of which are incorporated herein by reference.

TECHNICAL FIELD

This invention relates to concrete flatwork such as slabs and pavements, joints for such flatwork, and products for providing improved concrete flatwork joint performance.

BACKGROUND OF THE INVENTION

There are generally four types of joints used in concrete flatwork (slabs and pavements): isolation joints, expansion joints, construction joints and contraction joints. Isolation joints are used to create a separation between the concrete flatwork panel and adjacent panels or other building components, such as walls, columns, trenches, man-holes, bollards, etc. Expansion joints are used in the same way as an isolation joint except that it contains a compressible material or void space sufficient to accommodate subsequent expansion of the concrete flatwork panel(s). Construction joints are used at the termination of a single slab placement and thus defines the joint between adjacent panels cast independently. Construction joints are generally formed with removable or leave in place forms, sawcut full depth, or slip formed (temporary forms used with low slump concrete mixtures). Contraction joints are used as means of allowing for the concrete contraction by providing a plane of weakness. Contraction joints are often induced cracks created with the use of a saw cut, crack inducer, or tooled notch in the surface of the concrete.

Each joint type has its drawbacks and problems. Isolation joints often do not provide for positive load transfer between adjacent panels and other building components. Expansion joints are wider than other joints and therefore more prone to both joint spalling, such as damage to the joint edges, from wheeled traffic or other objects crossing and impacting the joint, and the intrusion of liquids. The intrusion of liquids can cause numerous problems including the pumping of saturated subgrade materials and faulting of pavement panels in exterior pavements, and subgrades heaving due to frost in cold climates or areas where expansive soils are found. Construction joints can also be prone to joint spalling under traffic especially if sufficient load transfer is not provided to create sufficient joint stability. Contraction joints are prone to dominant joint activation where some joints open wider than others, leading to the loss of load transfer through aggregate interlock thus also increasing the likelihood of joint spalling There are additional issues as well.

All four joint types are generally filled or sealed after their construction in an attempt to either protect the joint from spalling under traffic or prevent the ingress of moisture, liquids, contaminants, or bacteria. Load transfer with joint stability is most often provided in any of these joints through the use of either dowels, which are generally steel bars that are round or square in section, or keyways, which are tongue and groove type joints which can be formed with removable or leave in place forms.

There are products on the market that provide improved joint performance. Concerning load transfer, plate dowels are described in U.S. Pat. Nos. 6,354,760 and 7,481,031, the disclosures of which are incorporated by reference in their entireties. Concerning joint sealing, an assembly designed to seal joints during the construction stage and not afterwards is described in Patent Co-operation Treaty document number PCT/AU2009/001376, the disclosure of which is incorporated by reference in its entirety.

SUMMARY OF THE INVENTION

Products have not previously existed that have all the advantages of both load transfer and joint sealing according to the products of the cited and incorporated patent and document as opposed to the separate load transfer and joint sealing advantages of the separate products in the cited and incorporated patent and document. The envisioned products have never existed in an assembly for simplified use of the contractor. The invention, which includes both products and methods, combines a plate dowel and either an armored joint assembly or a joint sealing assembly with a leave-in-place and/or reusable formwork assembly. Unlike any other joint product or system it is envisioned to be used in place of any one of the four joint types described above and overcome the various drawbacks of them listed above. By providing the joint stability, joint protection (armoring) and/or joint sealing required in a single assembly with a leave-in-place and/or reusable form, the invention provides the opportunity for the contractor to place multiple panels at one time and negate the need for subsequent processes.

DETAILED DESCRIPTION OF THE INVENTION

Figure 1:
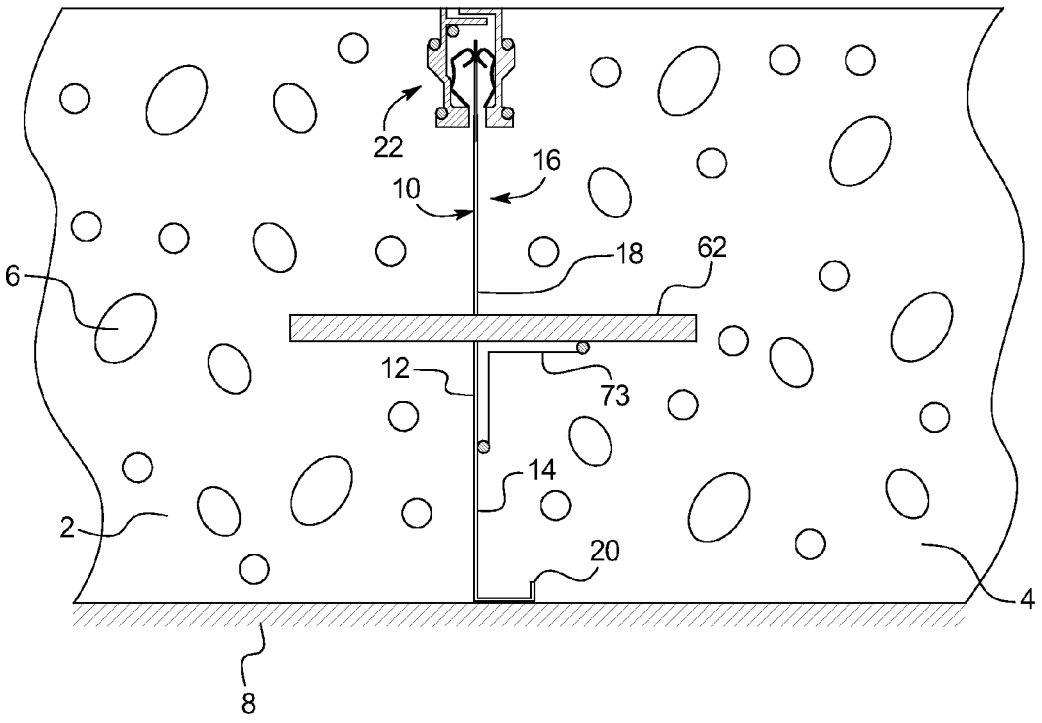
FIG. 1 is a cross-section through two slabs of concrete on a subgrade exposing in cross-section an embodiment of the joint assembly according to the invention.

As in FIG. 1, two slabs of concrete 2 and 4 are seen in cross-section when cut open or seen from their outer edges. The concrete has the usual construction of binder and inclusions such as aggregate 6. The slabs 2, 4 rest on a typical subgrade or base material 8.

A divider plate 10 defines the upright edges 12, 14 of the slabs 2, 4 at a joint 16 where the slabs are adjacent each other. They "meet" at the joint 16 in the sense that they terminate at the joint 16. They are also "separated" at the joint 16 in the sense that the divider plate 10 lies between them. They also further separate if the joint 16 between them is a construction and/or contraction joint and they move back from each other, under the action of concrete shrinkage or otherwise.

The divider plate 10 includes a vertically oriented extension 18, which extends from the subgrade or base 8 to the top of the slabs 2, 4. The extension 18 may have this extent by reason of incorporating a setting bracket 20 and a finishing and/or armoring structure 22 at set distances from each other equal to the desired heights of the slabs 2, 4, or be the same heights with exclusion of one or more of the setting bracket 20 and finishing strip 22, or be other extents relative to the slabs 2, 4 such as an extent shortened for saw cutting of the top portion of the joint 16.

As just expressed, the divider plate 10 as shown in FIG. 1 includes a plate support such as a setting bracket 20 and a top structure such as a finishing structure 22. The setting bracket 20 includes a planar horizontal portion for resting and/or fastening to the subgrade or base 8, or the plate support may include features similar to the bracket 20 which equivalently provide adequately for resting and/or fastening to the subgrade or base 8 and supporting the divider plate 10. Equivalents might, for example, include wires that project feet to the subgrade or base 8. They might include stakes driven into the subgrade or base 8 to which the plate support may attach. The setting bracket 20 also may be continuous along the joint 16 or intermittently project to the subgrade or base 8. The divider plate 10 may be metal, such as aluminum, or other materials as desired, such as plastic.

Figure 2:
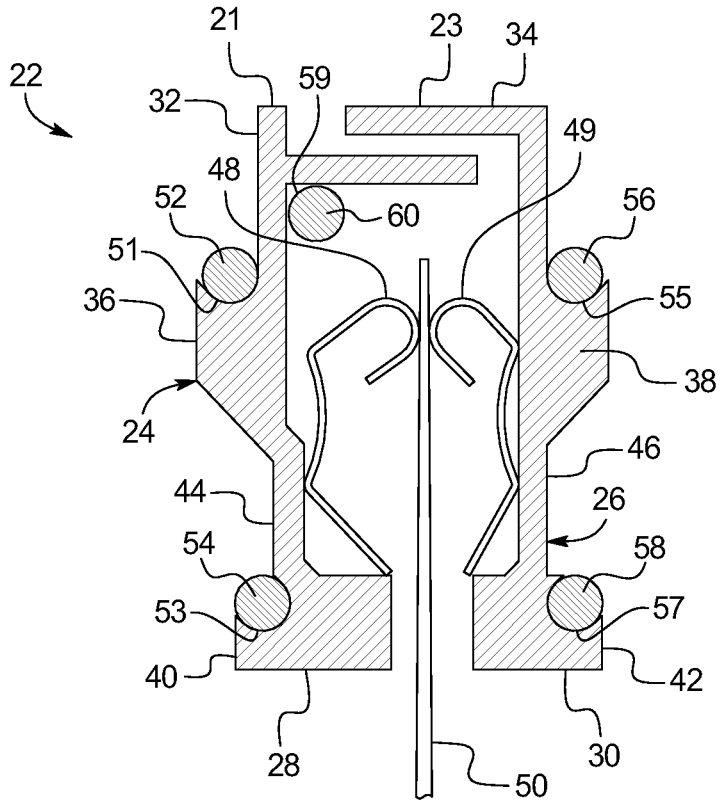
FIG. 2 is a detailed view of a portion of FIG. 1.

Again as just expressed, and as shown in larger size in FIG. 2, the divider plate includes a top structure such as a finishing and armoring structure 22. The extreme top surfaces 21, 23 of the structure 22 are substantially equal in height and provide guides for concrete surface finishing tools and equipment such as screeds, so as to permit accurate leveling, for example, of the tops of the slabs 2, 4.

The structure 22 as in FIG. 2 and some embodiments of invention also include(s) joint expansion and contraction elements such as co-operating rails 24, 26, upon which the top surfaces 21, 23 are formed. These elements are movable with their slabs as the slabs expand and/or contract, with the top surfaces 21, 23 moving closer together and farther apart as dictated by expansion and contraction.

Rails of the top structure may take various specific forms, as for example the rails 24, 26 take the form of substantially mirror-image components of greater height that width, and upper and lower elements 28, 30 and 32, 34 that extend toward each other in close vertical and horizontal association. The upper elements 32, 34 constitute as most preferred an overlapping pair of elements that by the turns of the minimal space between them create a short "labyrinth" of overlap and effectively "close" the space below themselves by their overlap.

The rails of a top structure may as in rails 24, 26, also have laterally extending segments 36, 38, 40, 42 that increase the thicknesses of portions of their upright elements 44, 46 and provide channels such as 51, 53, 55, 57 for seal elements such as 52, 54, 56, 58, such as hydrophilic gaskets of suitable rubber and the like. Additional channels and seal elements such as channel 59 and seal element 60 may also be included, in the case of 59, 60, for example, under upper element 32 of rail 24.

Retaining elements such as spring retaining elements 48, 49 may exist within the interiors of the rails such as rails 24, 26, or equivalent structures for fitting against the portion 50 of the divider plate 10 in the area of the top structure such as structure 22. The rails 24, 26 may be releasably fastened together at various locations to rest atop portion 50 during slab formation, or provided with structure that equivalently places rails 24, 26 in association with portion 50 during slab formation, such as clips and the like. The fastening elements should release the rails 24, 26 from each other and may release the rails 24, 26 from the portion 50 upon the appropriate degree of hardening of the slabs 24, 26.

The rails 24, 26 and all structures shown in FIG. 2 may be extended in longitudinal dimension (into the paper of FIG. 2) and be continuous extrusions or be intermittent in longitudinal extent, or otherwise, as for example, at various extents beyond their length exchanging or varying locations or sizes of specific structures. As most preferred, the rails and structures are continuous extrusions for manufacturing simplicity.

Figure 3:
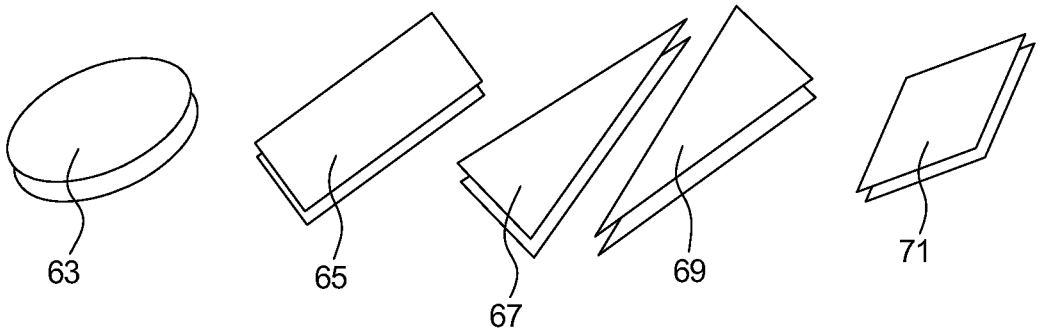
FIG. 3 is a set of perspective views of exemplary load transfer plates of the type of plate dowel 62 in FIG. 1.

Referring again to FIG. 1, the preferred embodiment may also include and most desirably does include load transfer plates such as for example plate dowel 62. As in the perspective views of FIG. 3, the plates may take on a variety of shapes, including oval 63, rectangular 65, alternating triangular 67, 69 and double triangular 71. Load plate supports such as load plate support bracket 73 in FIG. 1 are attached to and/or formed with or from divider plate 10. The load plate supports support load plates relative to divider plate 10 and assure or at least assist assuring proper orientations of load support plates for best use of the load plates.

In use, as by now perceived, to form a joint and pour two adjacent slabs simultaneously, the subgrade or base is prepared, as in FIG. 1, divider plates are extended and secured in series along the intended joint location for the distance the joint is to cover (or more or less), as in FIG. 1, load plates are installed on their supports, as in FIG. 1, top structures are installed, as in FIG. 1, and concrete slabs are poured. The stated steps are carried out in such orders as make sense, with some interchangeability of order, such as placing load plates last before pouring, installing top structures last before pouring, etc. To the extent appropriate, additional steps are also taken such as preparing the load plates to break from being locked into poured concrete at both ends, and the like. Concrete finishing using the top surfaces of the top structure may or may not occur, and indeed, more or less than all the structures shown may be included or excluded from the method, as for example, the top structures, which may or may not be included in some situations, if and where saw cutting to create joints is desired.

The invention and especially its preferred embodiment are now described in such full, clear and concise and exact manner as to enable a person of ordinary skill in the art to make and use the same. All embodiments of invention that come with the scope of claims to be appended on the preparation and filing of a non-provisional patent application are to be deemed to be covered by the claims.

The invention is claimed as follows:

1. A concrete slab joint assembly comprising:

a first castable-in-place rail having a first element and a second element extending transversely from the first element, and a second castable-in-place rail having a third element and a fourth element extending transversely from the third element, wherein the first rail and the second rail, when in use, are initially attached to a divider plate such that a portion of the divider plate is positioned between the first and second rails and such that a portion of the fourth element of the second rail overlaps a portion of the second element of the first rail, the divider plate, when in use, being positioned such that the divider plate separates a portion of a first concrete slab from a portion of an adjacent second concrete slab, wherein the first rail and the second rail, when in use, are initially attached to the divider plate such that the first rail and the second rail are movable relative to the divider plate when at least one of the first concrete slab and the second concrete slab expands or contracts and are cast in the first and second concrete slabs, respectively.

2. The concrete slab joint assembly of claim 1, wherein the first rail and the second rail, when in use, are initially attached to the divider plate such that a topmost surface of the first rail and a topmost surface of the second rail are generally a same distance from a topmost surface of the divider plate.

3. The concrete slab joint assembly of claim 2, wherein the first rail and the second rail, when in use, are initially attached to the divider plate such that the topmost surface of the first rail and the topmost surface of the second rail are generally coplanar.

4. The concrete slab joint assembly of claim 1, wherein the first rail and the second rail, when in use,. are initially attached to the divider plate such that the portion of the fourth element of the second rail is spaced apart from the portion of the second element of the first rail.

5. The concrete slab joint assembly of claim 1, wherein the first rail and the second rail, when in use, are initially attached to the divider plate such that the portion of the first element of the first rail overlapped by the portion of the second element of the second rail varies when at least one of the first rail and the second rail moves relative to the divider plate.

6. The concrete slab joint assembly of claim 1, wherein the first rail includes a first retaining element and the second rail includes a second retaining element.

7. The concrete slab joint assembly of claim 6, wherein the first rail and the second rail, when in use, are initially attached to the divider plate such that the first and second retaining elements contact the divider plate.

8. The concrete slab joint assembly of claim 7, wherein the first rail and the second rail, when in use, are initially attached to the divider plate such that the first retaining element contacts a first surface of the divider plate and the second retaining element contacts a second opposing surface of the divider plate.

9. The concrete slab joint assembly of claim 7, wherein the first and second retaining elements are spring retaining elements.

10. The concrete slab joint assembly of claim 1, wherein the first rail defines a longitudinal channel and includes a sealing element disposed in the longitudinal channel.

11. The concrete slab joint assembly of claim 10, wherein the sealing element includes a hydrophilic gasket.

12. The concrete slab joint assembly of claim 10, wherein the longitudinal channel is defined in an exterior surface of the first rail.

13. The concrete slab joint assembly of claim 10, wherein the longitudinal channel is defined by an interior surface of the first rail adjacent to the first element.

14. The concrete slab joint assembly of claim 1, wherein the first rail and the second rail, when in use, are initially attached to the divider plate via a plurality of fasteners, wherein said fasteners are configured to release the first and second rails from the portion of the divider plate upon appropriate hardening of the first and second concrete slabs.

15. There concrete slab joint assembly of claim 1, wherein the first rail and the second rail, when in use, are initially attached to one another via a plurality of fasteners, wherein said fasteners are configured to release the first and second rails from one another upon appropriate hardening of the first and second concrete slabs.

16. A concrete slab joint assembly comprising:

a divider plate positionable such that the divider plate separates a portion of a first concrete slab from a portion of an adjacent second concrete slab, a first rail having a first element and a second element extending transversely from the first element, a second rail having a third element and a fourth element extending transversely from the third element, and a load plate extendable into and between the first and second concrete slabs, wherein the first rail and the second rail, when in use, are initially attached to the divider plate such that a portion of the divider plate is positioned between the first and second rails and such that a portion of the fourth element of the second rail overlaps a portion of the second element of the first rail.

17. The concrete slab joint assembly of claim 16, wherein the first rail and the second rail, when in use, are initially attached to the divider plate such that the first rail and the second rail are movable relative to the divider plate when at least one of the first concrete slab and the second concrete slab expands or contracts.

18. A method of forming a joint between a first concrete slab and a second concrete slab, said method comprising:

securing a divider plate to a substrate, attaching a first rail and a second rail to the divider plate such that a portion of the divider plate is positioned between the first and second rails, such that a portion of an element of the second rail overlaps a portion of an element of the first rail, and such that the first rail and the second rail are movable relative to the divider plate when at least one of the first concrete slab and the second concrete slab expands or contracts, and thereafter:

(1) pouring the first concrete slab on a first side of the divider plate, and (2) pouring the second concrete slab on a second opposing side of the divider plate.

19. A concrete slab joint assembly comprising:

a first castable-in-place rail having a first element and a second element extending transversely from the first element, and a second castable-in-place rail having a third element and a fourth element extending transversely from the third element, wherein the first rail and the second rail, when in use, are initially attached to a divider plate such that a portion of the divider plate is positioned between the first and second rails, such that a portion of the fourth element of the second rail overlaps a portion of the second element of the first rail, and such that a topmost surface of the first rail and a topmost surface of the second rail are generally a same distance from a topmost surface of the divider plate, the divider plate, when in use, being positioned such that the divider plate separates a portion of a first concrete slab from a portion of an adjacent second concrete slab, the first rail and the second rail, when in use, being cast in the first and second concrete slabs, respectively.

20. A concrete slab joint assembly comprising:

a first castable-in-place rail having a first element and a second element extending transversely from the first element, and a second castable-in-place rail having a third element and a fourth element extending transversely from the third element, wherein the first rail and the second rail, when in use, are initially attached to a divider plate such that a portion of the divider plate is positioned between the first and second rails and such that a portion of the fourth element of the second rail overlaps and is spaced apart from a portion of the second element of the first rail, the divider plate, when in use, being positioned such that the divider plate separates a portion of a first concrete slab from a portion of an adjacent second concrete slab, the first rail and the second rail, when in use, being cast in the first and second concrete slabs, respectively.

21. A concrete slab joint assembly comprising:

a first castable-in-place rail having a first element, a second element extending transversely from the first element, and a first retaining element, and a second castable-in-place rail having a third element, a fourth element extending transversely from the third element, and a second retaining element, wherein the first rail and the second rail, when in use, are initially attached to a divider plate such that the first and second retaining elements contact the divider plate, such that a portion of the divider plate is positioned between the first and second rails, and such that a portion of the fourth element of the second rail overlaps a portion of the second element of the first rail, the divider plate, when in use, being positioned such that the divider plate separates a portion of a first concrete slab from a portion of an adjacent second concrete slab, the first rail and the second rail, when in use, being cast in the first and second concrete slabs, respectively.

22. The concrete slab joint assembly of claim 21, wherein the first rail and the second rail, when in use, are initially attached to the divider plate such that the first retaining element contacts a first surface of the divider plate and the second retaining element contacts a second opposing surface of the divider plate.

23. The concrete slab joint assembly of claim 21, wherein the first and second retaining elements are spring retaining elements.

24. A concrete slab joint assembly comprising:

a divider plate positionable such that the divider plate separates a portion of a first concrete slab from a portion of an adjacent a second concrete slab, a first castable-in-place rail having a first element and a second element extending transversely from the first element, and a second castable-in-place rail having a third element and a fourth element extending transversely from the third element, wherein the first rail and the second rail, when in use, are initially attached to the divider plate such that a portion of the divider plate is positioned between the first and second rails, such that a portion of the fourth element of the second rail overlaps a portion of the second element of the first rail, and such that the first rail and the second rail are movable relative to the divider plate when at least one of the first concrete slab and the second concrete slab expands or contracts, the first rail and the second rail, when in use, being cast in the first and second concrete slabs, respectively.

25. The concrete slab joint assembly of claim 24, wherein the first rail and the second rail, when in use, are initially attached to the divider plate such that the portion of the first element of the first rail overlapped by the portion of the second element of the second rail varies when at least one of the first rail and the second rail moves relative to the divider plate.

26. A concrete slab joint assembly comprising:

a divider plate positionable such that the divider plate separates a portion of a first concrete slab from a portion of an adjacent a second concrete slab, a first castable-in-place rail having a first element and a second element extending transversely from the first element, and a second castable-in-place rail having a third element and a fourth element extending transversely from the third element, wherein the first rail and the second rail, when in use, are initially attached to the divider plate such that a portion of the divider plate is positioned between the first and second rails, such that a portion of the fourth element of the second rail overlaps a portion of the second element of the first rail, and such that a topmost surface of the first rail and a topmost surface of the second rail are generally a same distance from a topmost surface of the divider plate, the first rail and the second rail, when in use, being cast in the first and second concrete slabs, respectively.

27. A concrete slab joint assembly comprising:

a divider plate positionable such that the divider plate separates a portion of a first concrete slab from a portion of an adjacent a second concrete slab, a first castable-in-place rail having a first element and a second element extending transversely from the first element, and a second castable-in-place rail having a third element and a fourth element extending transversely from the third element, wherein the first rail and the second rail, when in use, are initially attached to the divider plate such that a portion of the divider plate is positioned between the first and second rails and such that a portion of the fourth element of the second rail overlaps and is spaced apart from a portion of the second element of the first rail, the first rail and the second rail, when in use, being cast in the first and second concrete slabs, respectively.

28. A concrete slab joint assembly comprising:

a divider plate positionable such that the divider plate separates a portion of a first concrete slab from a portion of an adjacent a second concrete slab, a first rail having a first element, a second element extending transversely from the first element, and a first retaining element, and a second rail having a third element, a fourth element extending transversely from the third element, and a second retaining element, wherein the first rail and the second rail, when in use, are initially attached to the divider plate such that the first and second retaining elements contact the divider plate, such that a portion of the divider plate is positioned between the first and second rails, and such that a portion of the fourth element of the second rail overlaps a portion of the second element of the first rail, the first rail and the second rail, when in use, being cast in the first and second concrete slabs, respectively.

29. The concrete slab joint assembly of claim 28, wherein the first rail and the second rail, when in use, are initially attached to the divider plate such that the first retaining element contacts a first surface of the divider plate and the second retaining element contacts a second opposing surface of the divider plate.

30. The concrete slab joint assembly of claim 28, wherein the first and second retaining elements are spring retaining elements.

31. A method of forming a joint between a first concrete slab and a second concrete slab, said method comprising:

securing a divider plate to a substrate, attaching a first rail and a second rail to the divider plate such that a portion of the divider plate is positioned between the first and second rails, such that a portion of an element of the second rail overlaps a portion of an element of the first rail, and such that a topmost surface of the first rail and a topmost surface of the second rail are generally a same distance from a topmost surface of the divider plate, and thereafter:

(1) pouring the first concrete slab on a first side of the divider plate, and (2) pouring the second concrete slab on a second opposing side of the divider plate.

32. A method of forming a joint between a first concrete slab and a second concrete slab, said method comprising:

securing a divider plate to a substrate, attaching a first rail and a second rail to the divider plate such that a portion of the divider plate is positioned between the first and second rails and such that a portion of an element of the second rail overlaps and is spaced apart from a portion of an element of the first rail, and thereafter:

(1) pouring the first concrete slab on a first side of the divider plate, and (2) pouring the second concrete slab on a second opposing side of the divider plate.

33. A method of forming a joint between a first concrete slab and a second concrete slab, said method comprising:

securing a divider plate to a substrate, attaching a first rail having a first retaining element and a second rail having a second retaining element to the divider plate such that the first and second retaining elements contact the divider plate, such that a portion of the divider plate is positioned between the first and second rails, and such that a portion of an element of the second rail overlaps a portion of an element of the first rail, and thereafter:

(1) pouring the first concrete slab on a first side of the divider plate, and (2) pouring the second concrete slab on a second opposing side of the divider plate.

34. A method of forming a joint between a first concrete slab and a second concrete slab, said method comprising:

securing a divider plate to a substrate, attaching a load plate to the divider plate, the load plate extendable into and between the first and second concrete slabs, attaching a first rail and a second rail to the divider plate such that a portion of the divider plate is positioned between the first and second rails and such that a portion of an element of the second rail overlaps a portion of an element of the first rail, pouring the first concrete slab on a first side of the divider plate, and pouring the second concrete slab on a second opposing side of the divider plate.

* * * * *